United States Patent [19]

Bouplon

[11] 4,114,701

[45] Sep. 19, 1978

[54] DRILL ROD TABLE BUSHING ARRANGEMENT

[75] Inventor: Edward J. Bouplon, Streetsboro, Ohio

[73] Assignee: Chicago Pneumatic Tool Company, New York, N.Y.

[21] Appl. No.: 749,246

[22] Filed: Dec. 10, 1976

[51] Int. Cl.[2] ..... E21B 41/00

[52] U.S. Cl. ..... 175/84; 64/23.5; 166/82

[58] Field of Search ..... 173/165; 64/23.5, 23.7; 175/220, 83, 84, 228; 308/4 A; 166/82; 15/210 B

[56] References Cited

U.S. PATENT DOCUMENTS

| | | | |
|---|---|---|---|
| 2,758,891 | 4/1956 | Kammerer | 308/4 A |
| 2,829,866 | 4/1958 | Colquitt | 64/23.5 |
| 3,361,493 | 1/1968 | Melton | 308/4 A |
| 3,475,781 | 11/1969 | Grant | 166/82 |

*Primary Examiner*—Samuel Scott
*Assistant Examiner*—Gerald Anderson

[57] ABSTRACT

A drill rod table bushing arrangement which supresses drill steel whip while drilling under high thrust loads, and also prevents drill cuttings from accumulating on the drill table. A power operated ball wedge is operative to engage a drill rod, while high pressure air jets prevent drill cuttings from getting into the bushing.

5 Claims, 4 Drawing Figures

DRILL ROD TABLE BUSHING ARRANGEMENT

BACKGROUND OF THE INVENTION

This invention is concerned with the problem of drill steel stability during drilling operations, i.e, earth drilling operations.

In deep hole drilling operations, it is necessary to effectively engage the drill string at the ground surface. Such drill string engagement must be firm enough to provide desired drill string stability, yet allow movement of the drill string downward under rotary thrust load. A common expedient used is the provision of a bushing which is slightly oversize in relation to the outside diameter of the drill rod used in the drill string. After a short period of time, the drill cuttings coming from the hole being drilled, abrade the bushing and cause it to wear out, i.e., the inner diameter of the bushing is enlarged. As a result, the clearance between the bushing and drill rod will allow loose engagement of the bushing with the drill rod, causing the latter to become unstabilized resulting in drill rod whip with attendant damaging vibrations.

A prime object of this invention is to provide a drill rod table bushing arrangement which avoids drill rod whip during drilling operations.

A more specific object is to provide a drill rod table having a bushing arrangement which maintains a stabilizing grip on the drill rod even after prolonged use under high rotary thrust loading.

Another object is to provide a drill rod table having a bushing arrangement which has pneumatic pressure means to develop a stabilizing action on the drill rod being gripped thereby.

Still another object is to provide flow of pressurized fluid to restrict flow of drill cuttings upwardly into the bushing surrounding the drill rod.

BRIEF DESCRIPTION OF THE DRAWING

These and further objects and features of the invention will be more apparent from the following description and accompanying drawings wherein.

DESCRIPTION OF PREFERRED EMBODIMENT

Figure 2:
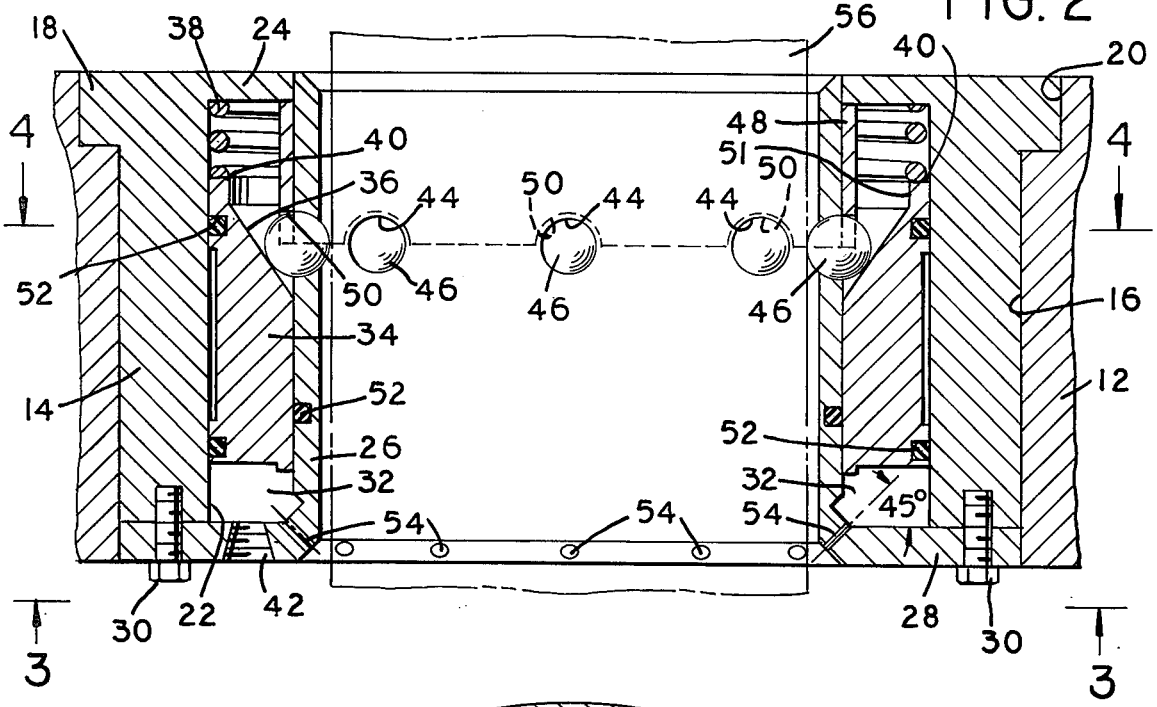
FIG. 2 is an enlarged section view as seen in the plane of line 2—2 on FIG. 1.

Referring now to the drawings, numeral 10 identifies a bushing assembly used in a drill rod surface table, a portion 12 of which is shown in FIG. 2. The assembly 10 includes a cylindrical bushing cylinder 14 which slidingly fits into a bore 16 formed in the surface table 12, and a shoulder portion 18 at its upper end which slidingly fits into a recess 20 formed in the surface table. Bushing cylinder 14 has an enlarged inner diameter portion 22 which extends almost the entire thickness of the bushing, the upper end terminating at a shoulder 24.

A cylinder bearing housing 26 is arranged within the bushing cylinder 14, the upper end being in snug engagement with the inner periphery of the bushing shoulder 24, the lower end having an integral flange 28 which is removably secured to the bottom of the bushing cylinder 14 by a plurality of fastening means, such as bolts 30. As best seen in FIG. 2, a cylindrical piston cavity 32 is thus provided between the bushing cylinder 14 and the bearing housing 26.

Figure 4:
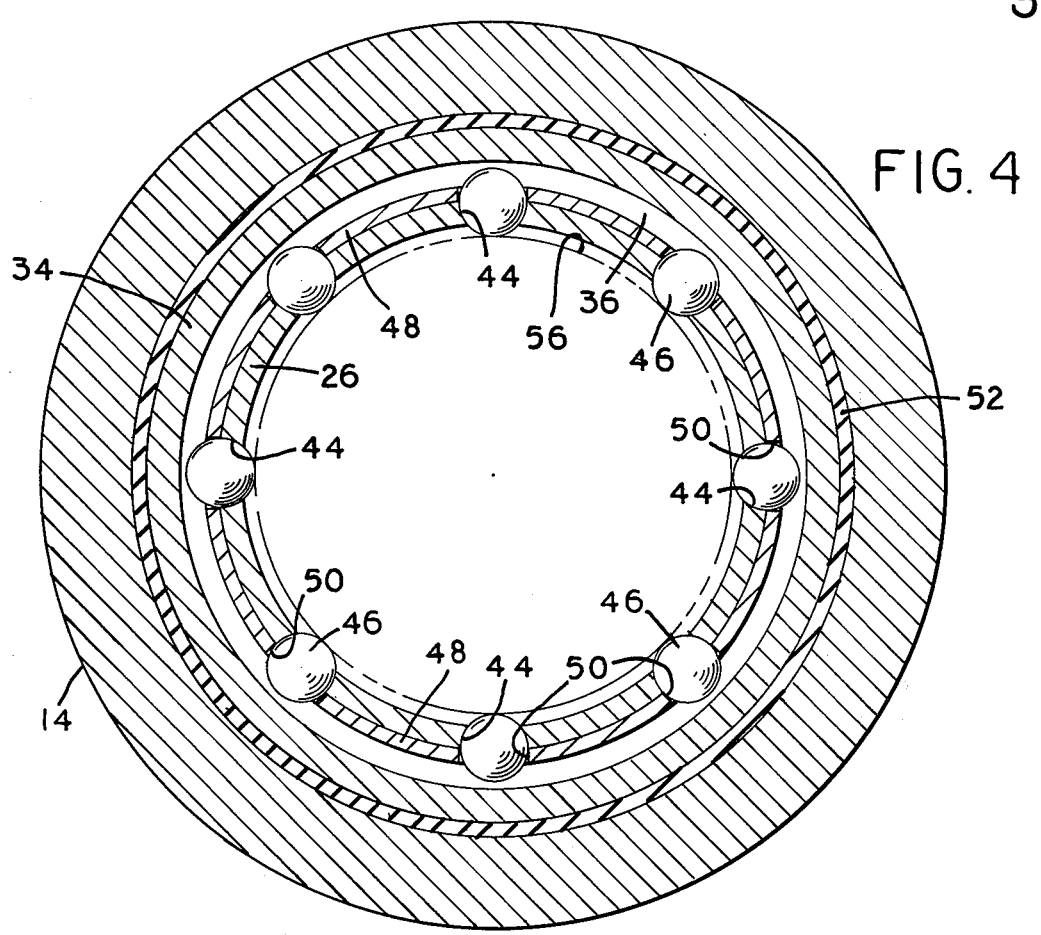
FIG. 4 is a section view as seen in plane of line 3—3 in FIG. 2.

Slidably disposed in the cavity 32 is a cylindrical piston 34, having a circumferential cam surface 36 formed in its upper end. A helical spring 38 is compressively arranged between the bushing cylinder shoulder 24, and a seating surface 40 formed on the upper end of the piston 34. A threaded opening 42 is arranged in the bearing housing shoulder 28 whereby pressure fluid, such as compressed air, can be admitted to that region of the cavity 32 below the piston 34. The bearing housing is provided with a plurality of dished holes 44 formed in a circumferential plane, each of said holes being arranged to receive a ball 46 in snug engagement with the concave surface of the hole. As best seen in FIGS. 2 and 4, the balls are restrained for limited protrusion within the inner peripheral surface of the bearing housing 26, by virtue of the concave surface of its respective hole 44. The balls are arranged to ride upon the cam surface 36, and are maintained thereagainst by means of a cylindrical ball bearing cage 48, the upper end of which engages the bushing cylinder shoulder 24, the lower end of which has a plurality of semi-circular recesses 50, each of which is in contact with a given ball 46. The upper end of the cam surface 36 terminates in vertically extending surface 51 defining an inner periphery adjacent the seating surface 40. The diameter of each ball 46 is greater than the distance between the outer peripheral surface of the bearing cage 48 and the vertical surface 51, which assures that each ball cannot move out of its respective recess 50 in the bearing cage, as when the piston 34 is in extreme downward position in the cavity 32. Elastic "O" rings 52, preferably made from commercially obtainable compound known as Buna A, are arranged to pneumatically seal the piston 34 in the cavity 32.

Figure 1:
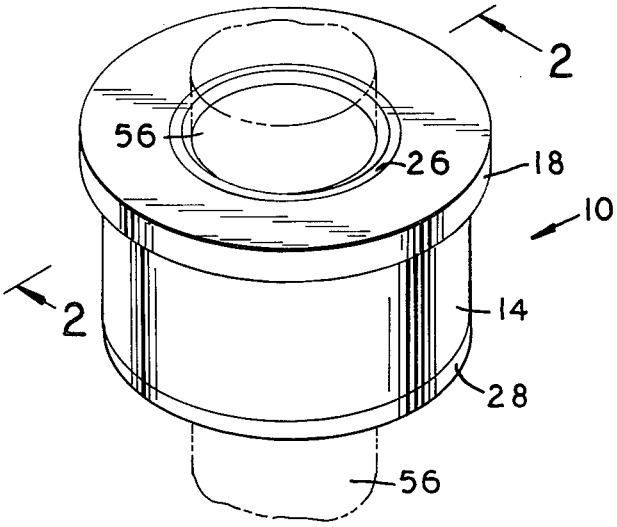
FIG. 1 is a perspective view of a drill rod table bushing arrangement incorporating the principle of the invention.
Figure 3:
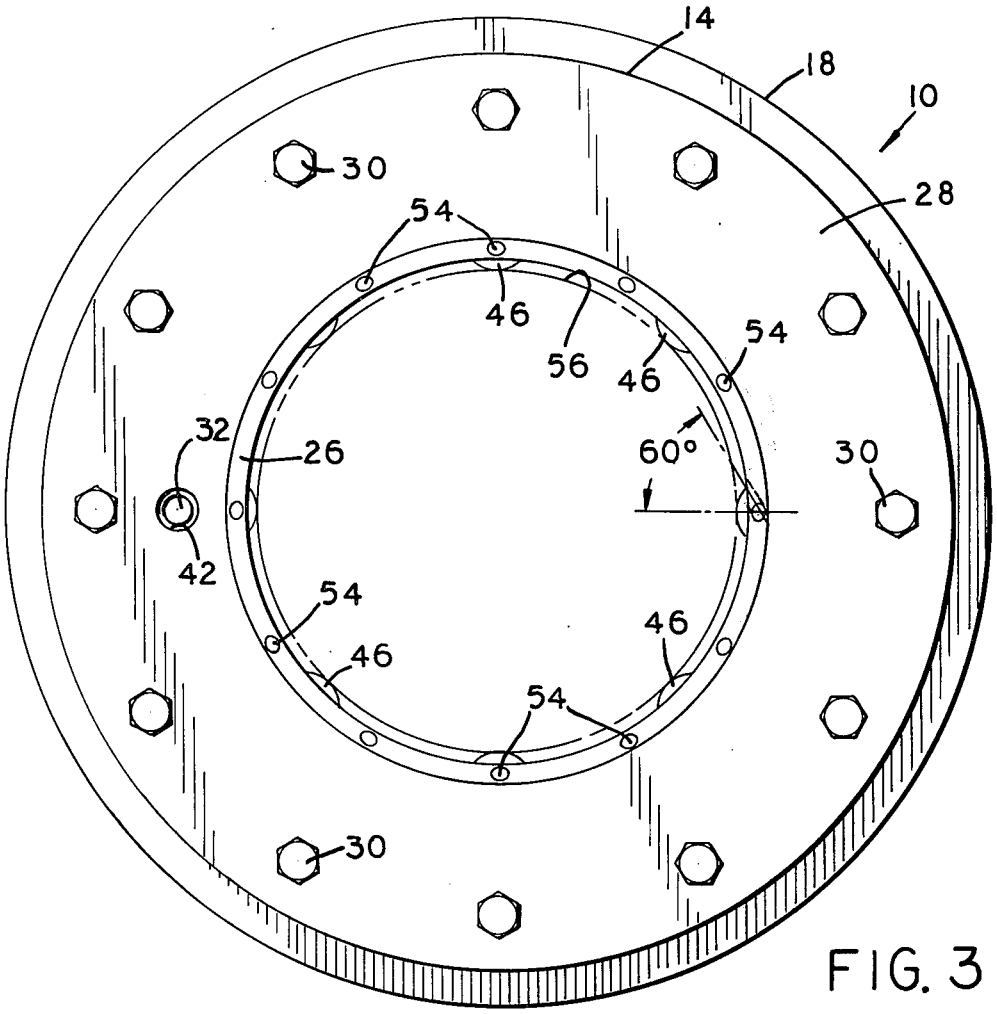
FIG. 3 is an end view as seen from line 3—3 in FIG. 2.

A plurality of small diameter passageways 54 are formed in the lower end of the bearing housing 26 in the region of the intersection of flange 28 with the body of the housing. The passageways serve to exhaust pressure fluid, e.g., compressed air at say 90 p.s.i., from the piston cavity 32, into a drill rod region within the bounds of the inner periphery of the bearing housing 26. The passageways are arranged to provide air jet impaction downwardly and tangentially upon the exterior surface of a drill rod 56, and may have angular orientation values as shown in FIGS. 2 and 3.

It will be seen that when pressurized air is admitted to the piston cavity 32, the piston will be moved upwardly moving the cam surface 36 to force the balls 46 into engagement with the wall of the drill rod 56, and the spring 38 will be compressed. Simultaneously, air jets directed from the passageways 54, will sweep over the exterior surface of the drill rod 56 to provide a continuous ring, or curtain of pressurized air which will restrict flow of drill cuttings into the region between the drill rod and the inner peripheral surface of the bearing housing 26.

In such manner, the drill bushing arrangement of the invention will effectively hold the drill rod centrally in the bushing, while allowing axial movement thereof under high thrust drilling load. Firm gripping action will stabilize the drill rod and prevent development of damaging vibration. When pressurized air is cut off from the piston cavity 32 by a control valve (not shown), the spring 38 will force the piston 34 downwardly in the cavity, thus relieving holding pressure of the balls 46 upon the drill rod. Simultaneously, air jetting action from the passageways 54 will be terminated.

It will be apparent that the drill bushing arrangement of the invention will satisfy all of the objectives of the invention as set forth hereinbefore in a simple and effective manner.

While an embodiment of the invention has been illustrated and described in detail, it is to be expressly understood that the invention is not limited thereto. Various changes in form, design or arrangement may be made in its parts without departing from the spirit and scope of the invention; it is my intention, therefore, to claim the invention not only as shown and described, but also in all such forms and modifications thereof as might be reasonably construed to be within the spirit of the invention and the scope of the appended claims.

I claim:

1. A drill rod table bushing arrangement comprising a bushing cylinder, a bearing housing arranged within the bushing cylinder, a piston cavity defined between the bushing cylinder and the bearing housing, a piston slidably arranged in the piston cavity, means to admit pressurized medium into the cavity to move the piston, a plurality of ball means movable inwardly of the bearing housing when the piston is moved by the pressurized medium, and a plurality of passageways arranged in the bearing housing to jet pressurized medium from the piston cavity to the interior of the bearing housing to restrict flow of drill cuttings between the bearing housing and a drill rod surrounded by the bearing housing when the bushing arrangement is being utilized.

2. A drill rod table bushing arrangement according to claim 1, wherein the piston has a cam surface which bears against the balls to cam them inwardly of the bearing housing.

3. A drill rod table bushing arrangement according to claim 2, wherein a spring means is arranged to urge the piston away from camming action upon the balls.

4. A drill rod bushing arrangement according to claim 3, wherein a bearing cage surrounds a portion of the bearing housing and is arranged to positionally maintain the balls in openings formed in the bearing cage.

5. A drill rod bushing arrangement according to claim 4, wherein the passageways are disposed to provide tangentially directed pressurized medium jets to the interior of the bearing housing.

* * * * *